US007409256B2

(12) United States Patent
Lin et al.

(10) Patent No.: US 7,409,256 B2
(45) Date of Patent: Aug. 5, 2008

(54) FOOTWEAR MEASUREMENT AND FOOTWEAR MANUFACTURE SYSTEMS AND METHODS

(75) Inventors: Ming-Hui Lin, Hsinchu County (TW); Tung-Wu Lu, Taipei County (TW); Shang-Yuan Cheng, Hsinchu (TW); Chien-Lin Lien, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 122 days.

(21) Appl. No.: 11/303,421

(22) Filed: Dec. 16, 2005

(65) Prior Publication Data

US 2007/0142955 A1 Jun. 21, 2007

(51) Int. Cl.
*G06F 19/00* (2006.01)
*G06F 15/00* (2006.01)
*A43D 1/02* (2006.01)

(52) U.S. Cl. ..... 700/98; 700/117; 703/11; 702/19; 702/155; 702/158; 702/167; 33/3 R

(58) Field of Classification Search ..... 700/30, 700/31, 49, 98, 117, 118, 182; 703/6, 11; 702/19, 155, 158, 166, 167; 602/65, 66; 33/3 R, 3 A, 3 B, 3 C, 4–6
See application file for complete search history.

(56) References Cited

U.S. PATENT DOCUMENTS

| | | | | |
|---|---|---|---|---|
| 5,164,793 | A * | 11/1992 | Wolfersberger et al. | 356/607 |
| 5,790,256 | A | 8/1998 | Brown et al. | |
| 7,206,718 | B2 * | 4/2007 | Cavanagh et al. | 702/155 |
| 2001/0020222 | A1 * | 9/2001 | Lee at al. | 702/155 |

* cited by examiner

*Primary Examiner*—Sean Shechtman
(74) *Attorney, Agent, or Firm*—Quintero Law Office

(57) ABSTRACT

Foot measurement and footwear manufacture systems and methods. A three-dimensional foot frame of a foot and pressure data corresponding to a bottom of the foot are measured, and a first and a second group of characteristic points are respectively determined accordingly. A preset foot skeleton template model is adjusted according to the second group of characteristic points, and merged into the three-dimensional foot frame according to the first group of characteristic points and protrusion points of the adjusted foot skeleton template model. The protrusion points and/or joint points of the adjusted foot skeleton template model are connected to generate at least one line and at least one plane, intersecting the three-dimensional foot frame at contact points and contact planes, respectively. The foot frame size is determined according to the distance between the contact points and the girth of the contact planes.

19 Claims, 11 Drawing Sheets

FOOTWEAR MEASUREMENT AND FOOTWEAR MANUFACTURE SYSTEMS AND METHODS

BACKGROUND

The present disclosure relates generally to foot measurement and footwear manufacture, and more particularly, to foot measurement and footwear manufacture systems and methods that integrate foot frame scanning and pressure measurement.

Recently, the footwear industry has become highly specialized and competitive. Manufacturers provide as many styles and sizes of shoes as possible to better meet various needs of consumers. Additionally, manufacturers can provide customized fit by measuring feet and choosing appropriate footwear for customers.

Several conventional techniques have been developed to measure the shape of feet in order to fabricate a customized footwear article. Techniques are based on laser scanning, image distribution, and template measurement to obtain a 3D map of the foot. Measurement results are easily influenced by variations in soft tissue, causing erroneous results. Users must be involved in foot measurement procedures, reducing accuracy, convenience and efficiency of foot measurement.

SUMMARY

Foot measurement and footwear manufacture systems and methods are provided.

An exemplary embodiment of a foot measurement and footwear manufacture system comprises a foot sizing unit comprising a first sensor assembly and a second sensor assembly, and a processing unit. The first sensor assembly measures a three-dimensional foot frame of a foot. The second sensor assembly measures the bottom of the foot to obtain corresponding pressure data. The processing unit receives the three-dimensional foot frame and the pressure data, and determines a first group of characteristic points according to the resulting three-dimensional foot frame, and a second group of characteristic points of the bottom of the foot according to the pressure data. The processing unit adjusts a preset foot skeleton template model according to the second group of characteristic points, and merges the adjusted foot skeleton template model into the three-dimensional foot frame according to the first group of characteristic points and protrusion points of the adjusted foot skeleton template model. The protrusion points and/or joint points of the adjusted foot skeleton template model are connected to generate at least one line and at least one plane, which intersect the three-dimensional foot frame at contact points and contact planes. The processing unit determines a foot frame size according to the distance between the contact points and the girth of the contact planes.

The processing unit further retrieves a footwear last from a database according to the foot frame size, and transmits the footwear last to a manufacturing unit to manufacture footwear accordingly.

In an exemplary embodiment of a foot measurement and footwear manufacture method, a three-dimensional foot frame of a foot and pressure data corresponding to the bottom of the foot are measured. A first group of characteristic points is determined according to the resulting three-dimensional foot frame, and a second group of characteristic points of the bottom of the foot is determined according to the pressure data. A preset foot skeleton template model is adjusted according to the second group of characteristic points, and merged into the three-dimensional foot frame according to the first group of characteristic points and protrusion points of the adjusted foot skeleton template model. The protrusion points and/or joint points of the adjusted foot skeleton template model are connected to generate at least one line and at least one plane, which intersect the three-dimensional foot frame at contact points and contact planes. A foot frame size is determined according to the distance between the contact points and the girth of the contact planes.

A footwear last is retrieved according to the foot frame size, and footwear is manufactured accordingly.

Foot measurement and footwear manufacture systems and methods may take the form of program code embodied in a tangible media. When the program code is loaded into and executed by a machine, the machine becomes an apparatus for practicing the disclosed method.

DESCRIPTION OF THE DRAWINGS

The invention will become more fully understood by referring to the following detailed description with reference to the accompanying drawings, wherein.

DESCRIPTION

Foot measurement and footwear manufacture systems and methods are provided.

Figure 1:
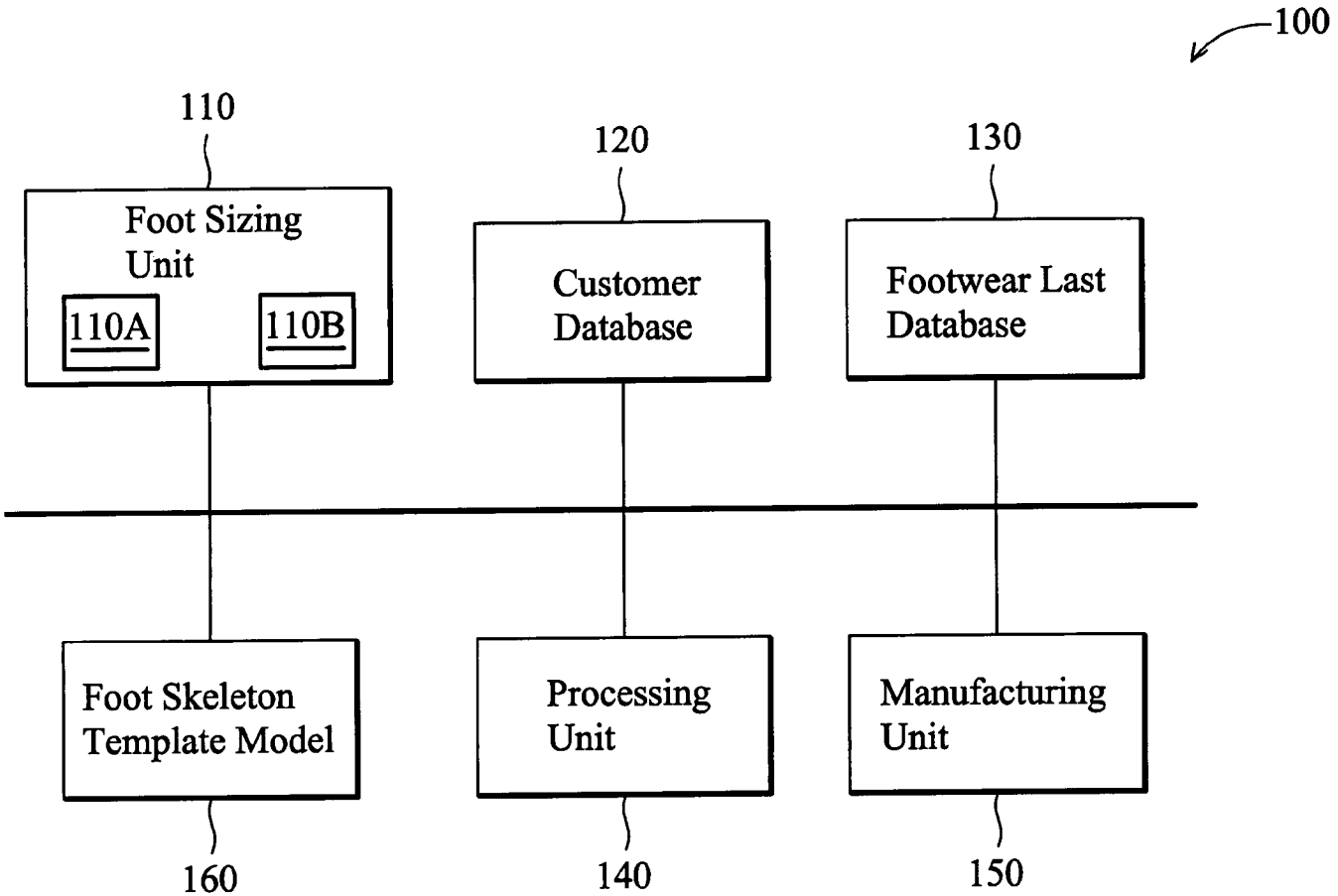
FIG. 1 is a schematic diagram illustrating an embodiment of a foot measurement and footwear manufacture system.

FIG. 1 is a schematic diagram illustrating an embodiment of a foot measurement and footwear manufacture system.

Figure 5A:
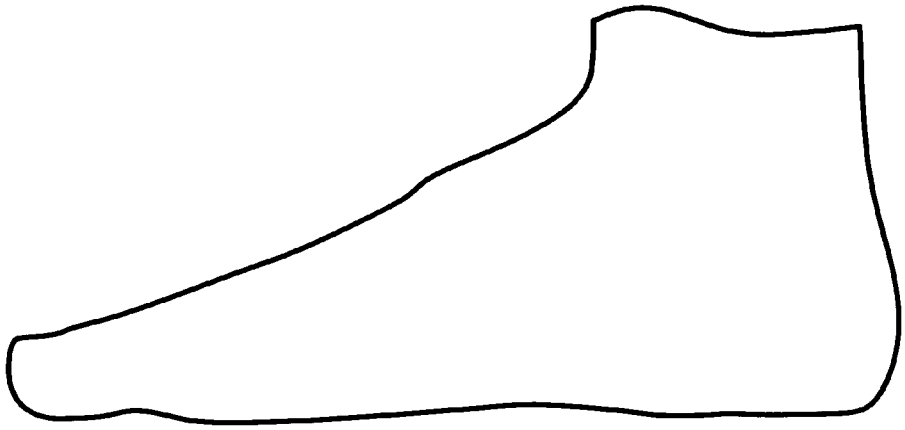
FIG. 5A is a side view of a three-dimensional foot frame.
Figure 5B:
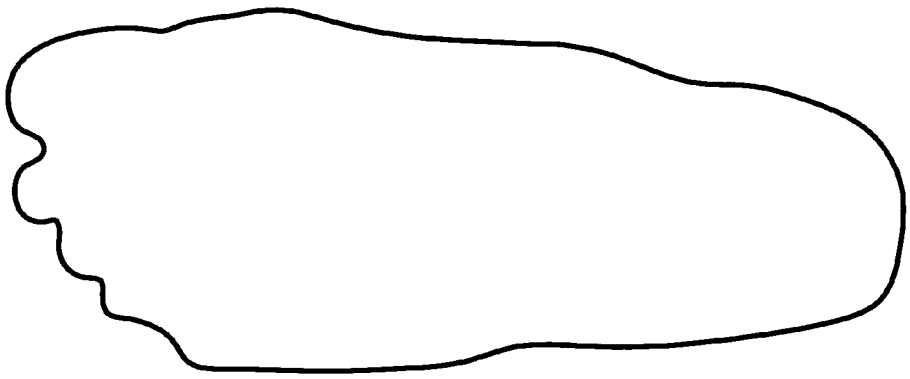
FIG. 5B is a bottom view of a three-dimensional foot frame.
Figure 6:
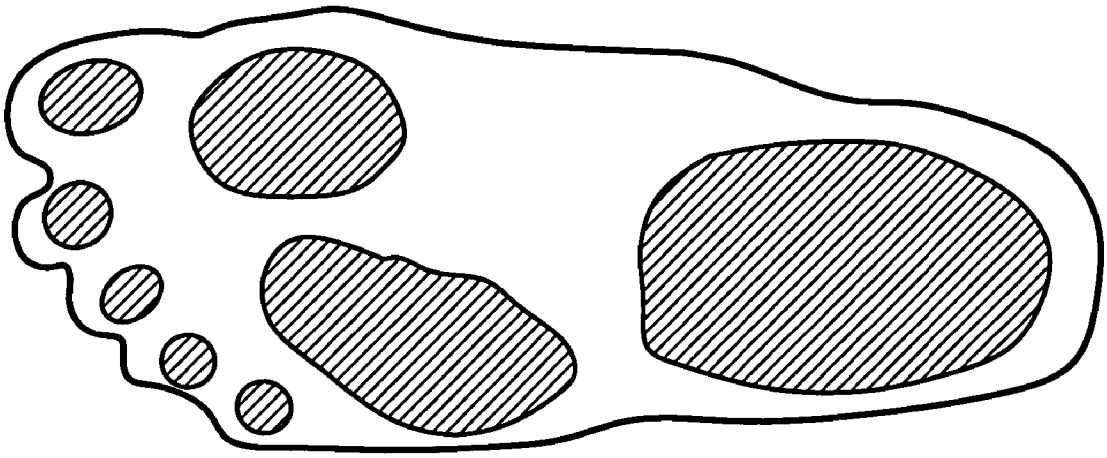
FIG. 6 shows pressure data corresponding to a bottom of a foot.
Figure 7A:
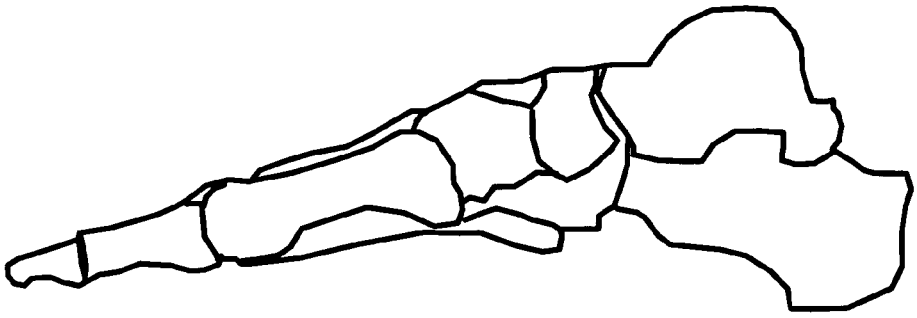
FIG. 7A is a side view of a foot skeleton template model.
Figure 7B:
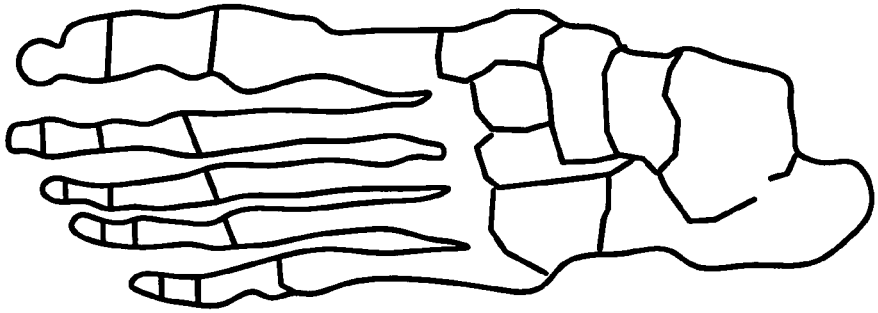
FIG. 7B is a bottom view of a foot skeleton template model.

The foot measurement and footwear manufacture system 100 comprises a foot sizing unit 110, a customer database 120, a footwear last database 130, a processing unit 140, and a manufacturing unit 150. The foot sizing unit 110 comprises a first sensor assembly 10A for measuring a three-dimensional foot frame of a foot, as shown in FIGS. 5A and 5B. The first sensor assembly may be, for example, a 3D scanner or a 3D camera. The foot sizing unit 110 further comprises a second sensor assembly 110B for measuring the bottom of the foot to obtain corresponding pressure data, as shown in FIG. 6. The second sensor assembly may be, for example, a pressure plate scanner. The customer database 120 records customer information such as customer identification and corresponding foot frame size. It is understood that the customer database 120 comprises interfaces (not shown) for managing (querying and establishing) the customer information. The footwear last database 130 records a plurality of footwear lasts, each having corresponding design specifications comprising one or more of foot length, medial ball length, lateral ball length, heel width distance, toe width, ball width, heel width, ball girth, waist girth, instep girth, toe height, joint height, instep height, arch height, forefoot axis angle, heel axis angle, first toe angle, fifth toe angle, joint angle, ridge curve, arch curve, back curve, footprint, and others. The processing unit 140 performs the foot measurement and footwear manufacture method of the invention. The manufacturing unit 150 manufactures footwear according to a specific footwear last retrieved from the footwear last database 130. Additionally, a foot skeleton template model 160 is provided in the system 100, as shown in FIGS. 7A and 7B. The foot skeleton template model 160 may be obtained by computerized axial tomography (CAT) scanning and three-dimensional computerized reconstruction.

Figure 2:
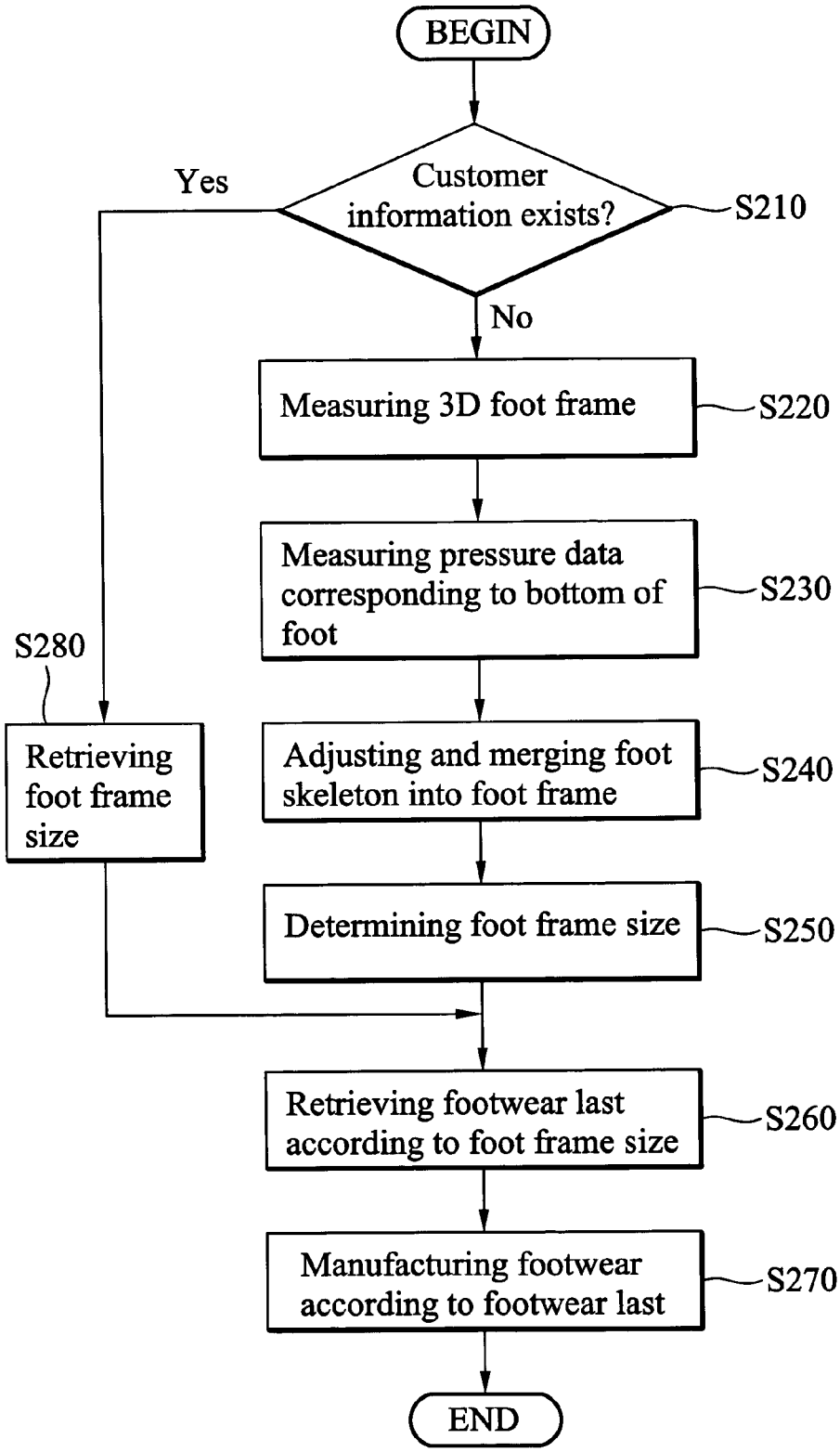
FIG. 2 is a flowchart showing an embodiment of a foot measurement and footwear manufacture method.

FIG. 2 is a flowchart showing an embodiment of a foot measurement and footwear manufacture method.

Figure 3:
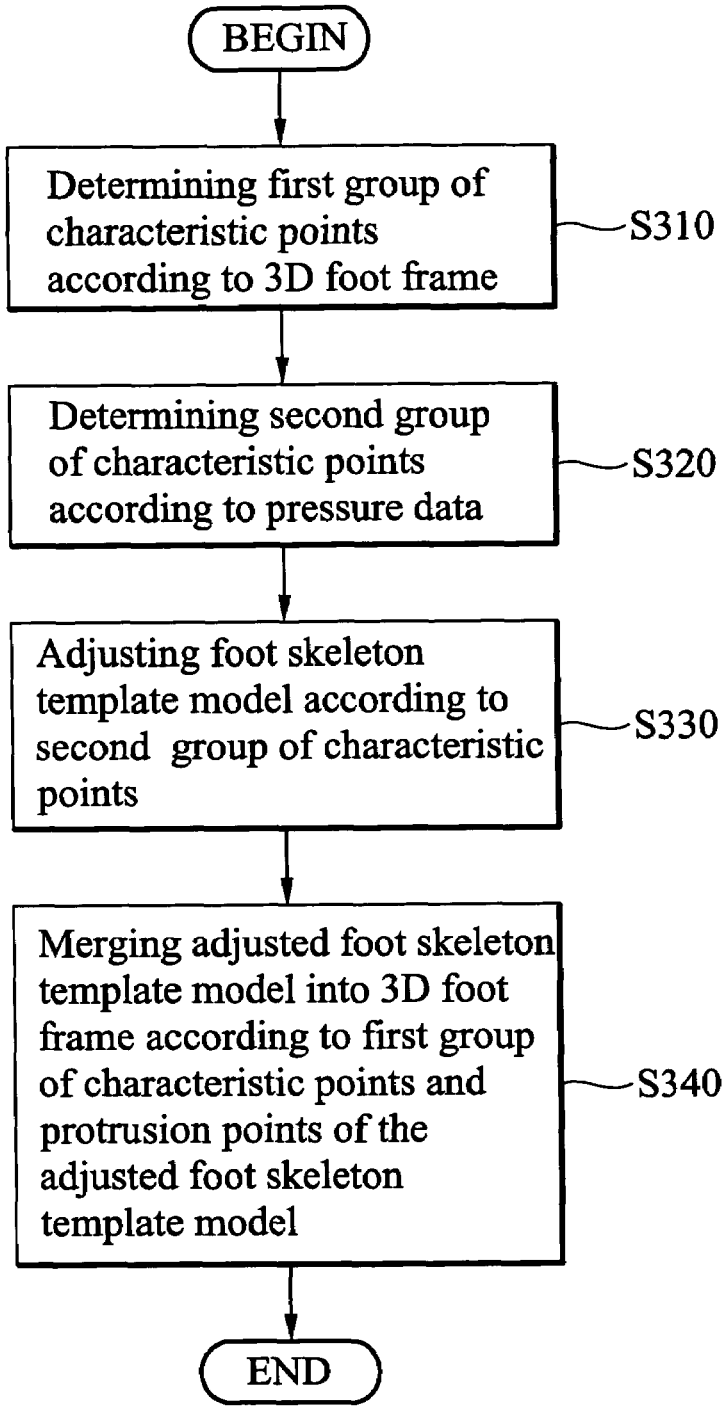
FIG. 3 is a flowchart showing an embodiment of a method for adjusting and merging a foot skeleton template model into a foot frame.
Figure 4:
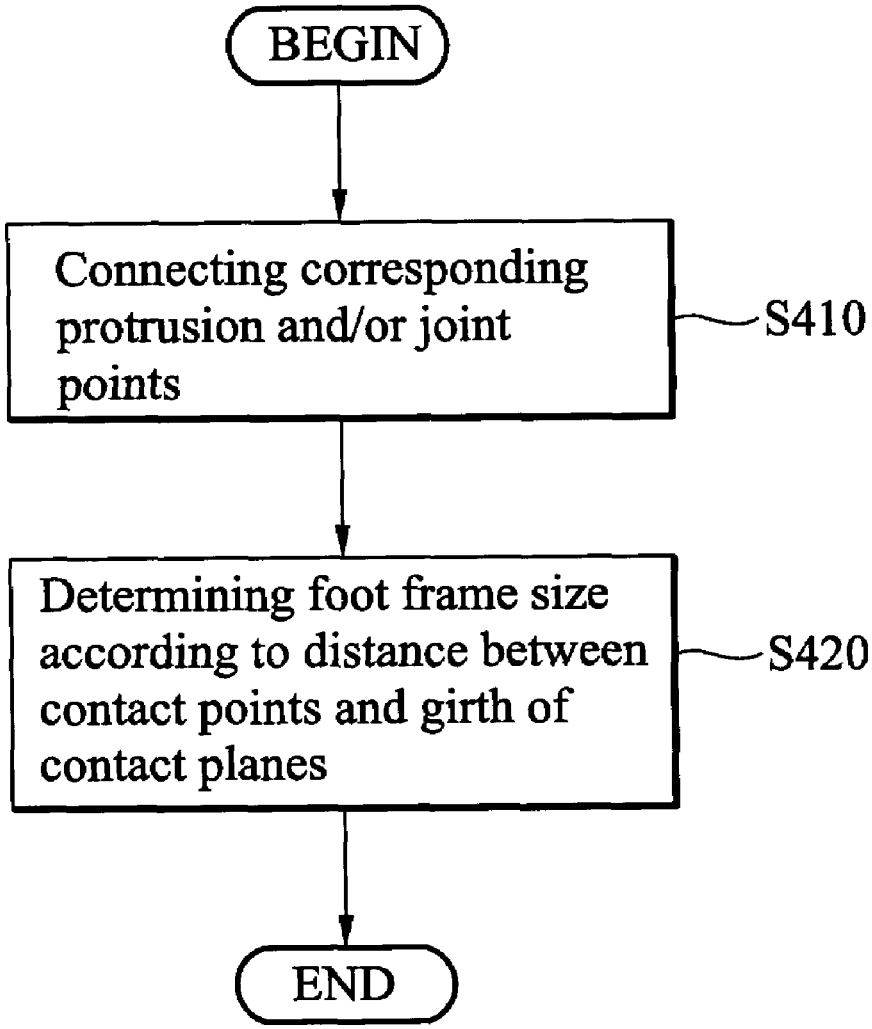
FIG. 4 is a flowchart showing an embodiment of a method for determining a foot frame size.

In step S210, it is determined whether information for a customer exists in the customer database 120. If so, in step S280, the foot frame size of the customer is retrieved from the customer database 120. If not, in step S220, a three-dimensional foot frame of a foot is measured, and in step S230, the bottom of the foot is measured to obtain corresponding pressure data. It is understood that steps S220 and S230 are preferably performed simultaneously on a reference surface (not shown) of the foot sizing unit 110. In step S240, the foot skeleton template model 160 is adjusted according to the pressure data corresponding to the bottom of the foot, and the adjusted foot skeleton template model 160 is merged into the three-dimensional foot frame. The adjustment and merge procedure is shown in FIG. 3. In step S250, the foot frame size of the customer is determined according to the three-dimensional foot frame having the adjusted foot skeleton template model 160. The determination of foot frame size is shown in FIG. 4. In step S260, a footwear last is retrieved from the footwear last database 130 according to the foot frame size, and in step S270, footwear is manufactured accordingly. It is understood that if the customer information does not exist in the customer database 120, the customer identification and corresponding foot frame size can be added to the customer database 120 after the foot frame size is determined.

FIG. 3 is a flowchart showing an embodiment of a method for adjusting and merging a foot skeleton template model into a foot frame.

Figure 8:
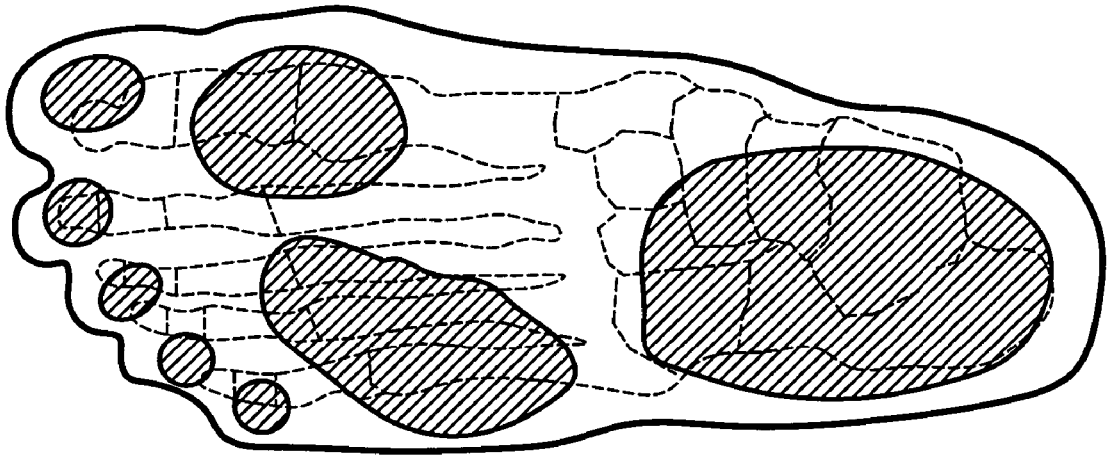
FIG. 8 is a schematic diagram illustrating an embodiment of foot skeleton template model adjustment using pressure data corresponding to a bottom of a foot.
Figure 9A:
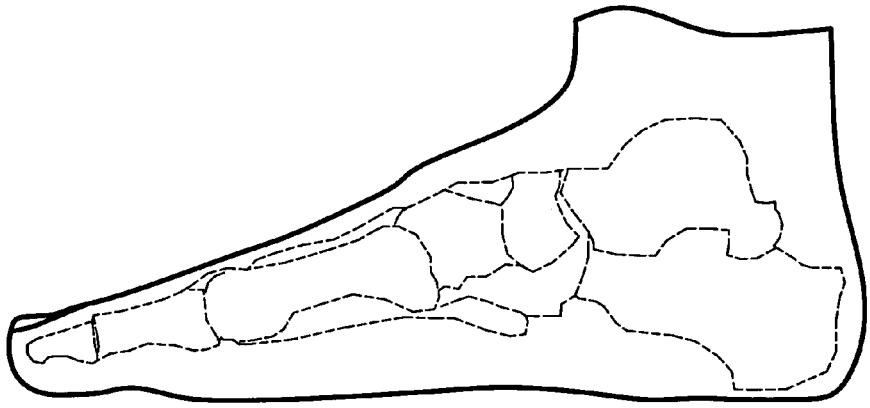
FIG. 9A is a side view of a three-dimensional foot frame merged with a foot skeleton template model.
Figure 9B:
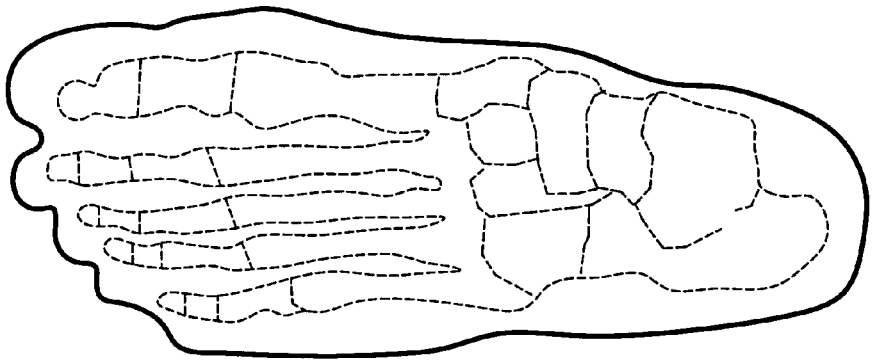
FIG. 9B is a bottom view of a three-dimensional foot frame merged with a foot skeleton template model.

In step S310, a first group of characteristic points is determined according to the three-dimensional foot frame. The first group of characteristic points comprises one or more of pternion, foot length, second toe tip, medial ball, lateral ball, medial heel, lateral heel, inner ball, outer ball, toe height, joint height, instep height, and arch height points. It is understood that recognition of the first group of characteristic points is well known, and further discussion is therefore omitted herefrom. In step S320, a second group of characteristic points of the bottom of the foot is determined according to the pressure data. The second group of characteristic points comprises supporting points of the bottom of the foot. As described, the first and second sensor assemblies obtain corresponding data. The simultaneous or near simultaneous measurements of three-dimensional foot frame and pressure data are performed on a reference surface of the foot sizing unit 110, such that the positions of the characteristic points in the second group relative to those in the first group are known. In step S330, the foot skeleton template model 160 is adjusted according to the second group of characteristic points of the pressure data corresponding to the bottom of the foot, as shown in FIG. 8. In the adjustment, respective protrusion points of the foot skeleton template model are mapped to corresponding supporting points (second group of characteristic points). Additionally, since respective characteristic points in the first group of the three-dimensional foot frame correspond to protrusion points of a skeleton, the foot skeleton template model 160 can be further adjusted accordingly, such that the protrusion points of the adjusted foot skeleton template model 160 correctly correspond to the characteristic points in the first group. It is understood that, in some embodiments, the foot skeleton template model 160 can be divided into a plurality of foot skeletons, for example, a front foot skeleton, a middle foot skeleton, and a rear foot skeleton, and each foot skeleton adjusted respectively. After adjustment, the adjusted foot skeleton template model 160 becomes a personal foot skeleton for the customer. In step S340, the adjusted foot skeleton template model 160 is merged into the three-dimensional foot frame according to the first group of characteristic points and the protrusion points of the adjusted foot skeleton template model, as shown in FIGS. 9*a* and 9B. It is understood that the protrusion points of the adjusted foot skeleton template model must correspond to the characteristic points in the first group of the three-dimensional foot frame.

FIG. 4 is a flowchart showing an embodiment of a method for determining a foot frame size.

Figure 10A:
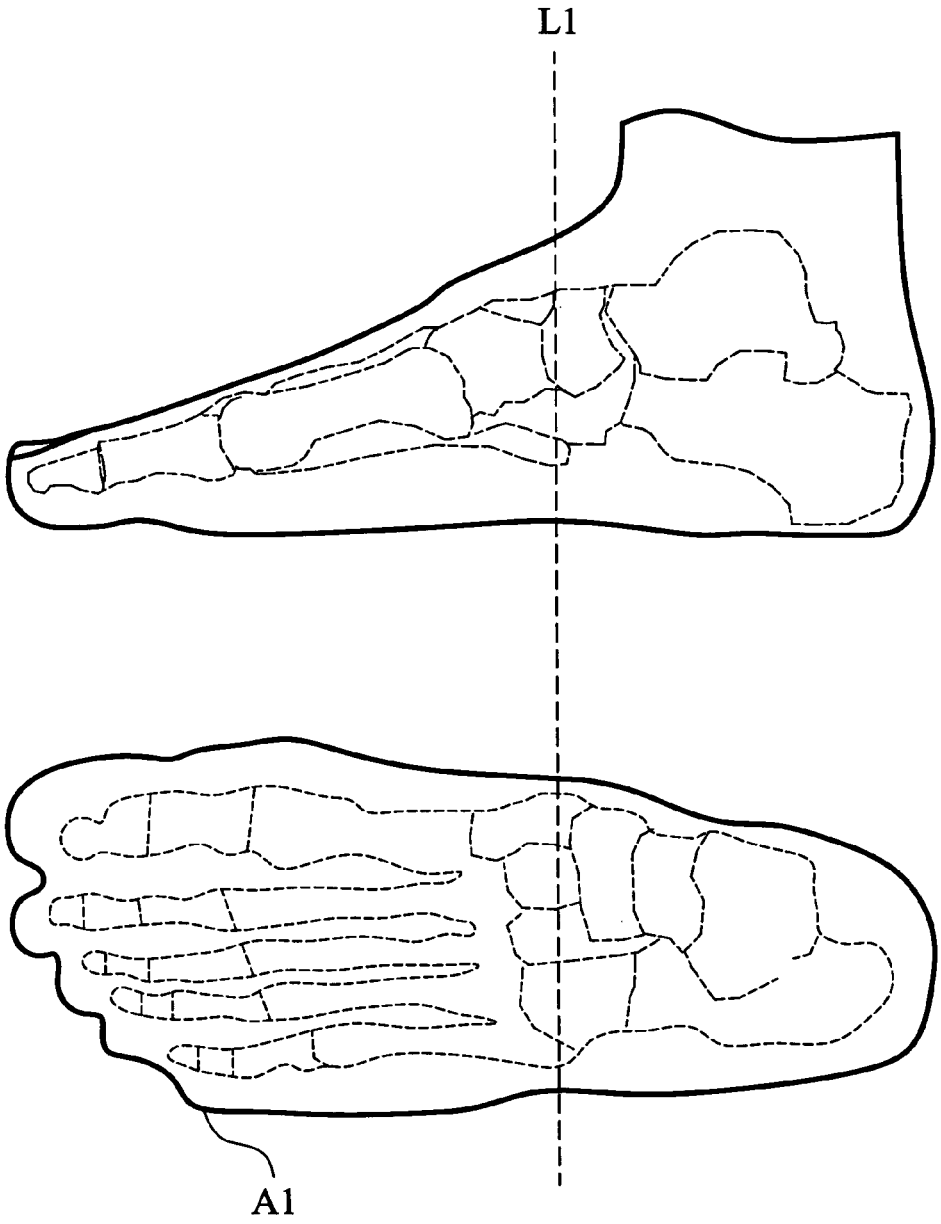
FIG. 10A shows a side view and a bottom view of a three-dimensional foot frame with a skeleton characteristic point.
Figure 10B:
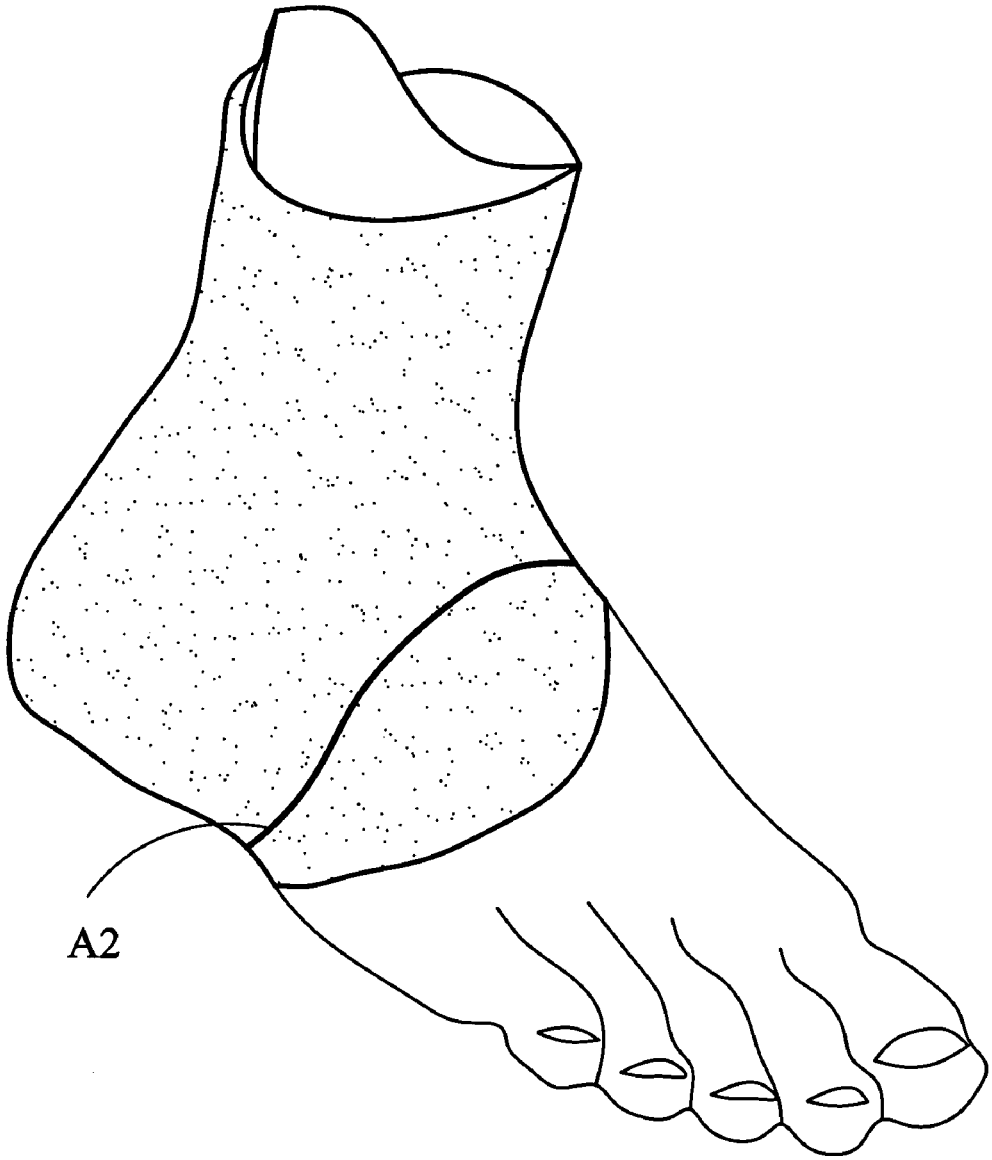
FIG. 10B shows a side view and a bottom view of a three-dimensional foot frame with a section.

In step S410, the corresponding protrusion points and/or joint points of the adjusted foot skeleton template model 160 are connected to generate at least one line and at least one plane. It is understood that the corresponding protrusion points and/or joint points can be flexible and depended on respective manufacturers, and be selected from the skeleton characteristic points. The line and plane intersect the three-dimensional foot frame at contact points and contact planes. In step S420, foot frame size is determined according to the various distances between the contact points and the girth of the contact planes. The foot frame size comprises one or more of a foot length, a medial ball length, a lateral ball length, a heel width distance, a toe width, a ball width, a heel width, a ball girth, a waist girth, an instep girth, a toe height, a joint height, an instep height, an arch height, a forefoot axis angle, a heel axis angle, a first toe angle, a fifth toe angle, a joint angle, a ridge curve, an arch curve, a back curve, and a footprint, each having definitions of distance or girth corresponding to at least two connected characteristic points and additional limitations, detail of which is omitted herefrom. For example, after the adjusted foot skeleton template model is merged into the three-dimensional foot frame, the corresponding points such as A1 on the three-dimensional foot frame of one skeleton characteristic point can be determined, as shown in FIG. 10A. Then, the foot frame size can be determined on various skeleton positions according to respective foot frame size definitions. For example, if the depth of the foot at line L1 is measured, the corresponding skeleton characteristic points are connected, and the connected lines or plane intersect the three-dimensional foot frame to generate a section A2, as shown in FIG. 10B. The girth of A2 is then calculated as the depth of the foot at line L1.

Thus, foot measurement integrates foot frame scanning and pressure measurement, with customized footwear manufactured accordingly.

Foot measurement and footwear manufacture systems and methods, or certain aspects or portions thereof, may take the form of program code (i.e., executable instructions) embodied in tangible media, such as products, floppy diskettes, OD-ROMS, hard drives, or any other machine-readable storage medium, wherein, when the program code is loaded into and executed by a machine, such as a computer or a device comprising a mobile phone, the machine thereby becomes an apparatus for practicing the methods. When implemented on a general-purpose processor, the program code combines with the processor to provide a unique apparatus that operates analogously to application specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A foot measurement and footwear manufacture system, comprising:

a foot sizing unit comprising:

a first sensor assembly for measuring a three-dimensional foot frame of a foot; and a second sensor assembly for measuring the bottom of the foot to obtain corresponding pressure data; and a processing unit receiving the three-dimensional foot frame and the pressure data, determining a first group of characteristic points according to the three-dimensional foot frame, and a second group of characteristic points of the bottom of the foot according to the pressure data, adjusting a preset foot skeleton template model according to the second group of characteristic points, merging the adjusted foot skeleton template model into the three-dimensional foot frame according to the first group of characteristic points and protrusion points of the adjusted foot skeleton template model, connecting the protrusion points and/or joint points of the adjusted foot skeleton template model to generate at least one line and at least one plane, in which each line and plane intersect the three-dimensional foot frame at contact points and a contact plane respectively, and determining a foot frame size according to the distance between at least one pair of contact points and the girth of at least one contact plane.

2. The system of claim 1 wherein the first group of characteristic points comprises one or more of pternion, foot length, second toe tip, medial ball, lateral ball, medial heel, lateral heel, inner ball, outer ball, toe height, joint height, instep height, and arch height points.

3. The system of claim 1 wherein the second group of characteristic points comprises supporting points of the bottom of the foot.

4. The system of claim 1 wherein the processing unit further adjusts the preset foot skeleton template model by mapping respective protrusion points of the preset foot skeleton template model to corresponding second group of characteristic points.

5. The system of claim 4 wherein the processing unit further divides the preset foot skeleton template model into a plurality of skeletons, and adjusts the divisions respectively.

6. The system of claim 4 wherein the processing unit further divides the preset foot skeleton template model into a front foot skeleton, a middle foot skeleton, and a rear foot skeleton, and adjusts the divisions respectively.

7. The system of claim 1 wherein the foot frame size comprises one or more of a foot length, a medial ball length, a lateral ball length, a heel width distance, a toe width, a ball width, a heel width, a ball girth, a waist girth, an instep girth, a toe height, a joint height, an instep height, an arch height, a forefoot axis angle, a heel axis angle, a first toe angle, a fifth toe angle, a joint angle, a ridge curve, an arch curve, a back curve, and a footprint.

8. The system of claim 1 further comprising:

a database comprising footwear last data; and a manufacturing unit;

wherein the processing unit further retrieves a footwear last from the database according to the foot frame size, and transmits the footwear last to the manufacturing unit to manufacture footwear accordingly.

9. The system of claim 1 wherein the first sensor assembly and second sensor assembly are configured to obtain data at substantially the same time.

10. The system of claim 1 wherein the processing unit further adjusts the foot skeleton template model according to the characteristic points in the first group of the three-dimensional foot frame, such that the protrusion points of the adjusted foot skeleton template model correctly correspond to the characteristic points in the first group.

11. A foot measurement and footwear manufacture method, comprising:

measuring a three-dimensional foot frame of a foot, and determining a first group of characteristic points accordingly;

measuring the bottom of the foot to obtain corresponding pressure data, and determining a second group of characteristic points of the bottom of the foot accordingly;

adjusting a preset foot skeleton template model according to the second group of characteristic points;

merging the adjusted foot skeleton template model into the three-dimensional foot frame according to the first group of characteristic points and protrusion points of the adjusted foot skeleton template model;

connecting the protrusion points and/or joint points of the adjusted foot skeleton template model to generate at least one line and at least one plane, in which each line and plane intersect the three-dimensional foot frame at contact points and a contact plane, respectively;

determining a foot frame size according to the distance between at least one pair of contact points and the girth of at least one contact plane;

retrieving a footwear last from a database according to the foot frame size; and manufacturing footwear accordingly.

12. The method of claim 11 wherein the first group of characteristic points comprises one or more pternion, foot length, second toe tip, medial ball, lateral ball, medial heel, lateral heel, inner ball, outer ball, toe height, joint height, instep height, or arch height points.

13. The method of claim 11 wherein the second group of characteristic points comprises supporting points of the bottom of the foot.

14. The method of claim 11 further comprising adjusting the preset foot skeleton template model by mapping respective protrusion points of the preset foot skeleton template model to a corresponding second group of characteristic points.

15. The method of claim 14 further comprising dividing the preset foot skeleton template model into a plurality of skeletons, and adjusting the divisions respectively.

16. The method of claim 14 further comprising dividing the preset foot skeleton template model into a front foot skeleton, a middle foot skeleton, and a rear foot skeleton, and adjusting the divisions respectively.

17. The method of claim 11 wherein the foot frame size comprises one or more of a foot length, a medial ball length, a lateral ball length, a heel width distance, a toe width, a ball width, a heel width, a ball girth, a waist girth, an instep girth, a toe height, a joint height, an instep height, an arch height, a forefoot axis angle, a heel axis angle, a first toe angle, a fifth toe angle, a joint angle, a ridge curve, an arch curve, a back curve, and a footprint.

18. The method of claim 11 wherein the steps of measuring the three-dimensional foot frame of a foot and measuring the bottom of the foot to obtain corresponding pressure data are performed at substantially the same time.

19. The method of claim 11 further comprising adjusting the foot skeleton template model according to the characteristic points in the first group of the three-dimensional foot frame, such that the protrusion points of the adjusted foot skeleton template model correctly correspond to the characteristic points in the first group.

* * * * *